US006920297B2

(12) United States Patent
Itabashi

(10) Patent No.: US 6,920,297 B2
(45) Date of Patent: Jul. 19, 2005

(54) IMAGE FORMING APPARATUS THAT CLEANS A WIRE OF A CHARGER

(75) Inventor: Nao Itabashi, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 116 days.

(21) Appl. No.: 10/670,361

(22) Filed: Sep. 26, 2003

(65) Prior Publication Data

US 2004/0062565 A1 Apr. 1, 2004

(30) Foreign Application Priority Data

Sep. 27, 2002 (JP) ..... 2002-284265

(51) Int. Cl.[7] ..... G03G 15/02
(52) U.S. Cl. ..... 399/100; 250/324
(58) Field of Search ..... 399/100, 115, 399/170, 171, 172, 173; 250/324, 325; 361/229

(56) References Cited

U.S. PATENT DOCUMENTS 5,023,748 A * 6/1991 Okamoto et al. ..... 399/100
5,323,215 A 6/1994 Ohtaka et al. ..... 399/89
6,580,885 B2 * 6/2003 Walgrove et al. ..... 399/100

FOREIGN PATENT DOCUMENTS

| | | |
|---|---|---|
| JP | A 3-100569 | 4/1991 |
| JP | A-4-310980 | 11/1992 |
| JP | U-5-84965 | 11/1993 |
| JP | A 5-289474 | 11/1993 |
| JP | A 8-6464 | 1/1996 |
| JP | A-9-101660 | 4/1997 |
| JP | A-11-295950 | 10/1999 |
| JP | A 2001-222153 | 8/2001 |

* cited by examiner

*Primary Examiner*—Arthur T. Grimley
*Assistant Examiner*—Ryan Gleitz
(74) *Attorney, Agent, or Firm*—Oliff & Berridge, PLC

(57) ABSTRACT

An image forming apparatus wherein a wire of a charger is cleaned while a process unit is attached to or removed from a casing. A cleaning unit pinches the wire of the charger therein slidably, and reciprocates to clean the wire when the process unit is attached to or removed from the casing.

16 Claims, 9 Drawing Sheets

REAR
FRONT
60a
16
57
55
47
53L
53R
62

60a
16
74
55
71
60a
53R
REAR
53L
47
16
74
55
71
53L
53R
47
72
16
74
55
53R
53L
71
FRONT
47
60L
73
60R

IMAGE FORMING APPARATUS THAT CLEANS A WIRE OF A CHARGER

BACKGROUND OF THE INVENTION

1. Field of Invention

The invention relates to an electrophotographic image forming apparatus such as a laser printer.

2. Description of Related Art

Laser printers typically include a process cartridge containing a photosensitive drum, a scorotron charger disposed facing the photosensitive drum, and a developing device. Such a process cartridge can also be attached to and removed from a casing. The scorotron charger is provided with a wire for discharging electricity that is disposed along a rotation axis of the photosensitive drum and a cleaning unit for removing foreign materials such as dust adhered to the wire. A cleaning unit is provided such that it is slidable along the length of the wire while holding the wire. The process cartridge is removed from the casing and the cleaning unit is manually moved along the length of the wire, so that the wire is cleaned.

Japanese Laid-Open Patent Publication No. 8-6464 discloses an apparatus where a process cartridge is attached to and removed form a casing in a direction parallel to the longitudinal direction of a wire, that is, the axis of a photosensitive drum. At the time of attachment or removal of the process unit, an actuator held in the casing is engaged with a cleaning unit and the cleaning unit slides on the wire concurrently with the attachment or removal of the process unit, thereby dust adhered to the wire is cleaned.

However, in the above method, as the process cartridge is removed from the casing parallel to the axis of the photosensitive drum, a bearing that supports one end of a support shaft of the photosensitive drum is provided in a cover that opens and closes at the time of attachment and removal of the process cartridge. For this structure, the positioning accuracy of the photosensitive drum cannot be obtained, which may lead to a loss of image quality.

SUMMARY OF THE INVENTION

The invention thus provides an image forming apparatus that improves the positioning accuracy of the photosensitive drum and simplifies the cleaning of the wire concurrently with the attachment and removal of the process unit.

According to one exemplary aspect of the invention, the invention includes an image forming apparatus with a photosensitive device, a wire disposed along an axial direction of the photosensitive device, a cleaning unit slidably contacting the wire along a longitudinal direction of the wire, a process unit supporting the photosensitive device, the wire and the cleaning unit, a guide portion that accommodates the process unit, is perpendicular to the longitudinal direction of the wire and guides the process unit upon movement of the process unit, and a moving device that moves the cleaning unit in the longitudinal direction of the wire in synchronization with the movement of the process unit.

BRIEF DESCRIPTION OF THE DRAWINGS

Various embodiments of the invention will be discussed with reference to the drawings, wherein.

DETAILED DESCRIPTION OF PREFERRED EMBODIMENTS

Figure 1:
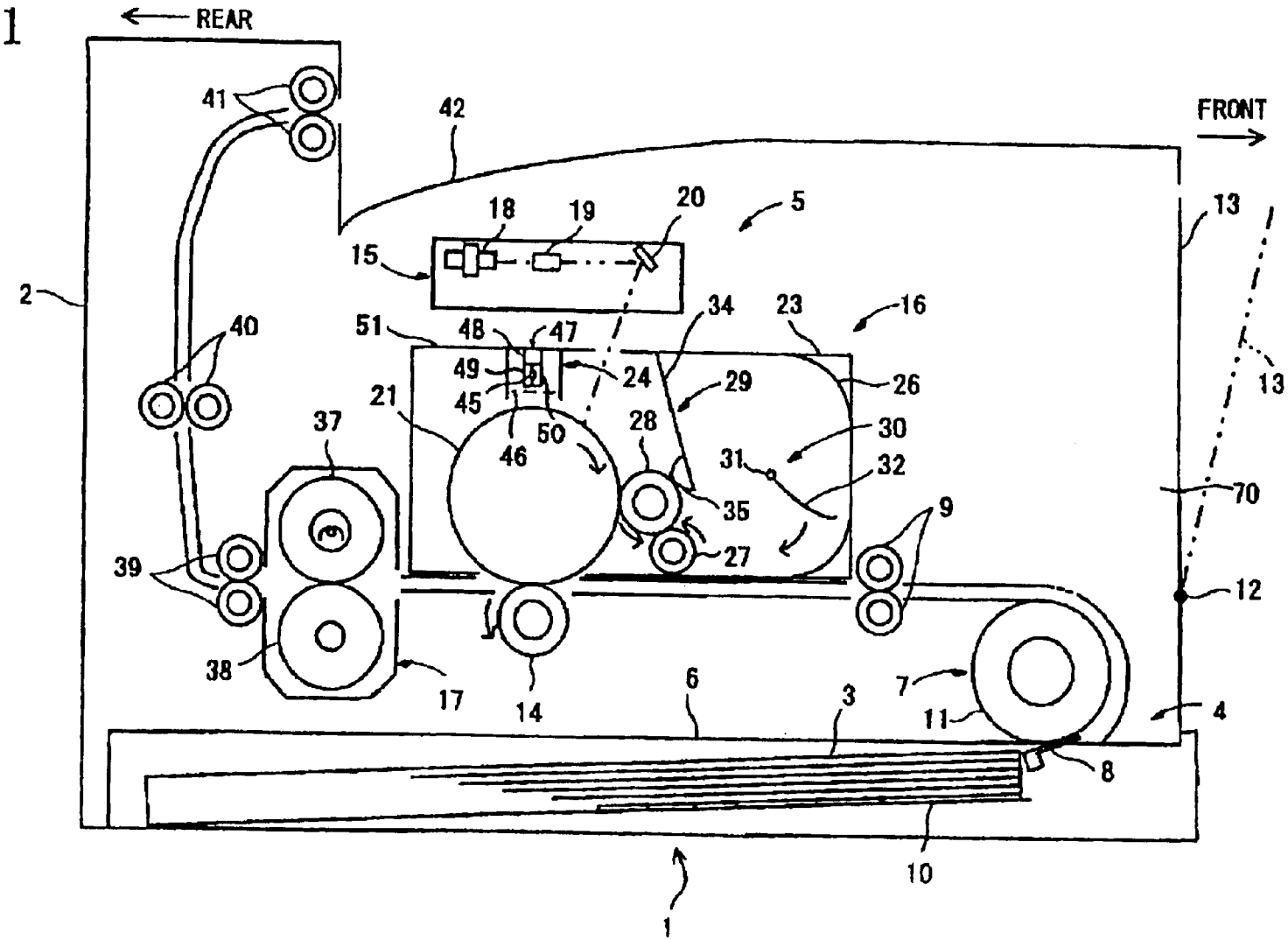
FIG. 1 is a side sectional view of principal parts of a laser printer according to an embodiment of the invention.

In FIG. 1, a laser printer 1 is an electrophotographic laser printer where an imaging process is conducted using a monocomponent, non-magnetic development system. A casing 2 includes a feeder unit 4 that supplies sheets 3 into the laser printer 1, and an image forming unit 5 where images are formed on supplied sheets 3. In the following, a side where a paper feed roller 11 is provided is a front side of the laser printer 1, and a side where a fixing unit 17 is provided is a rear side of the laser printer 1.

The feeder unit 4 is provided at a bottom portion of the casing 2, and includes a sheet feed tray 6, which is detachably attached to the bottom portion of a casing 2, a sheet feed mechanism 7 provided at a front end of the sheet feed tray 6, and resist rollers 9 provided downstream from the sheet feed mechanism 7 in a sheet feed direction.

The sheet feed tray 6 is of an open-top box shape, and accommodates sheets 3 to be stacked thereon. The sheet feed tray 6 is detachable from the front of the casing 2 horizontally with respect to the bottom of the casing 2. A presser plate 10 is provided in the sheet feed tray 6. The presser plate 10 allows sheets 3 to be stacked thereon. The presser plate 10 is pivotally supported at its rear end remote from the sheet feed mechanism 7 such that the presser plate 10 is vertically movable at its front end closest to the paper feed mechanism 7. A spring (not shown) is disposed on the reverse side of the presser plate 10, and urges the presser plate 10 upwardly. When the stack of sheets 3 increases in quantity, the presser plate 10 swings downwardly about the rear end of the presser plate 10, against the urging force of the spring.

The sheet feed mechanism 7 includes the sheet feed roller 11, a separation pad 8 disposed facing the sheet feed roller 11, and a spring, not shown, disposed on the reverse side of the separation pad 8. The separation pad 8 is urged toward the sheet feed roller 11 by the urging force of the spring. An uppermost sheet 3 in the stack on the presser plate 10 is pressed against the sheet feed roller 11 by the spring provided on the reverse side of the presser plate 10. When the sheet feed roller 11 rotates, the uppermost sheet 3 is pinched between the sheet feed roller 11 and the sheet feed pad 8 and separated from the stack. Thus, the sheets 3 are fed one by one from the top of the stack to the resist rollers 9. The resist rollers 9 are a pair of rollers designed to receive the leading edge of a sheet 3, correct its orientation, and then feed it to an image forming position, that is, a contact between a photosensitive drum 21 and a transfer roller 14.

The image forming unit 5 includes a scanner unit 15, a process unit 16, the transfer roller 14, and a fixing unit 17.

The scanner unit 15 is provided in an upper portion of the casing 2 and has a laser emitting portion (not shown), a polygonal mirror 18 that rotates at a high speed, a lens 19, and a reflecting mirror 20. In the scanner unit 15, a laser beam emitted from the laser emitting portion based on predetermined image data sequentially passes through or reflects from the polygonal mirror 18, the lens 19, the reflecting mirror 20 in order as indicated by a broken line in FIG. 1. The laser beam is thus directed to the surface of the photosensitive drum 21, which will be described later.

The process unit 16 is made up of the photosensitive drum 21 disposed in a substantially rectangular box shaped housing 51, a developing cartridge 23, and a scorotron charger 24. The process unit 16 is detachably attached to the casing 2 below the scanner unit 15.

A front cover 13 is provided at the front of the casing 2. The front cover 13 is rotatably supported at its lower end via a hinge 12 such as to swing at its upper end in the front-to-rear direction. The process unit 16 can be attached to and removed from the casing 2 through the front cover 13 open in a place indicated by a double dashed chain line.

The developing cartridge 23 is detachably attached to the housing 51 of the process unit 16, and includes a toner hopper 26, a supply roller 27 provided on a side of the toner hopper 26, a developing roller 28, and a layer thickness-regulating blade 29.

As the developing cartridge 23 is provided detachably with respect to the housing 51 of the process unit 16, the photosensitive drum 21 and the developing cartridge 23 can be replaced with new ones in accordance with their respective service lives. Thus, the photosensitive drum 21 and the developing cartridge 23 are individually replaced with new ones in an appropriate timing, thereby reducing operating costs.

The developing cartridge 23 can be attached to and removed from the casing 2 while remaining attached to the housing 51 of the process unit 16. In other words, the developing cartridge 23 cannot be attached to or removed from the casing 2 alone. The developing cartridge 23 is structured such that it is attached to and removed from the housing 51 of the process unit 16, which is removed from the casing 2.

When the developing cartridge 23 needs replacing, the process unit 16 is removed from the casing 2, and the spent developing cartridge 23 is removed from the housing 51 of the removed process unit 16. A new developing cartridge 23 is attached to the housing 51 of the process unit 16 and then the process unit 16 is attached to the casing 2.

The toner hopper 26 contains positively charged nonmagnetic single-component toner. The toner used in this embodiment is a polymerized toner obtained through copolymerization of styrene-based monomers, such as styrene, and acryl-based monomers, such as acrylic acid, alkyl (C1–C4) acrylate, or alkyl (C1–C4) methacrylate, using a known polymerization method, such as suspension polymerization. The particle shape of such a polymerized toner is spherical, its particle size is approximately 6–10 $\mu$m and thus the polymerized toner has excellent flowability. A coloring agent, such as carbon black, and wax are added to the polymerized toner. An external additive, such as silica, is also added to the polymerized toner to improve flowability.

The toner hopper 26 is provided with an agitator 30. The agitator 30 includes a rotating shaft 31 rotatably supported at a central position in the toner hopper 26, and an agitating blade 32 provided at the side of the rotating shaft 31. When the rotating shaft 31 of the agitator 30 rotates in a direction of an arrow in FIG. 1, the agitating blade 32 moves in the direction and conveys toner in the toner hopper 26 to the supply roller 27.

The supply roller 27 is disposed at the side of the toner hopper 26 such that its axial direction is parallel to a width direction of the housing 51 of the process unit 16, that is, a direction substantially perpendicular to a direction where the process unit 16 is attached or removed. The supply roller 27 rotates in a direction of an arrow shown in FIG. 1. The supply roller 27 is made up of a metallic roller shaft and a roller portion formed from a conductive urethane sponge, and the metallic roller shaft is covered with the roller portion.

The developing roller 28 is disposed facing the supply roller 27 such that its axial direction is parallel to the width direction of the housing 51 of the process unit 16. The developing roller 28 rotates in a direction of an arrow shown in FIG. 1. The developing roller 28 is made up of a metallic roller shaft and a roller portion formed from an electrically conductive rubber material, and the metallic roller shaft is covered with the roller portion. More specifically, the roller portion of the developing roller 28 is formed from an electrically conductive urethane or silicone rubber containing fine carbon particles, coated with a urethane or silicone rubber containing fluorine. A developing bias is applied to the roller shaft of the developing roller 28. The supply roller 27 and the developing roller 28 are disposed facing each other and in contact with each other so that the supply roller 27 press-deforms against the developing roller 28 to an appropriate extent. The supply roller 27 and the developing roller 28 rotate in opposite directions at the contact portion.

The layer thickness-regulating blade 29 is disposed facing the developing roller 28 along the axial direction of the developing roller 28 above the supply roller 27. The layer thickness-regulating blade 29 includes a plate spring 34 and a presser portion 35 disposed on a distal end of the plate spring 34 and formed from an electrically insulative silicone rubber. In a state where the plate spring 34 of the layer thickness-regulating blade 29 is supported by the developing cartridge 23, the presser portion 35 is pressed against the developing roller 28 by the elastic force of the plate spring 34.

Toner conveyed to the supply roller 27 by the rotation of the agitator 30 is supplied to the developing roller 28 by the rotation of the supply roller 27. While the toner is supplied from the supply roller 27 to the developing roller 28, it is positively charged between the supply roller 27 and the developing roller 28 due to friction. The charged toner is carried on the developing roller 28, and passes between the developing roller 28 and the presser portion 35 by the rotation of the developing roller 28. When passing between the developing roller 28 and the presser portion 35, toner is further charged due to friction, and formed into a thin layer on the developing roller 28.

The photosensitive drum 21 is disposed facing the developing roller 28 such that its width direction is parallel to a width direction of the housing 51 of the process unit 16. The photosensitive drum 21 is formed by coating a grounded cylindrical aluminum drum with a positively charged photosensitive layer made of polycarbonate. Bearings (not shown) are pressed-fit around both ends of the photosensitive drum 21. One of the bearings functions as a gear. The photosensitive drum 21 and the bearings rotate integrally. A metal shaft passes through the bearings and is supported to the housing 51 of the process unit 16.

The scorotron charger 24 is a positive charging type scorotron charger and generates a corona discharge. The scorotron charger 24 is disposed above the photosensitive drum 21 and separated therefrom by a predetermined distance so as not to contact the photosensitive drum 21, and is supported by the housing 51 of the process unit 16. The scorotron charger 24 includes a wire 45, a grid electrode 46, and a cleaning unit 47.

The wire 45 is formed of tungsten, and disposed facing the photosensitive drum 21 along the axial direction of the photosensitive drum 21. A corona discharge is generated through the application of a voltage to the wire 45, and the surface of the photosensitive drum 21 is charged positively and uniformly. A casing of the scorotron charger 24 has an opening, which is open toward the photosensitive drum 21, and the grid electrode 46 is provided at the opening along the longitudinal direction of the wire 45. The cleaning unit 47 includes a base 48 and two pinching members 49 and 50, which are provided at the base 48, that pinch the wire 45 slidably therebetween.

The transfer roller 14 is disposed facing the photosensitive drum 21 beneath such that its axial direction is parallel to the width direction of the housing 51 of the process unit 16. The transfer roller 14 is made up of a metallic roller shaft and a roller portion formed from an electrically conductive rubber material, and the metallic roller shaft is covered with the roller portion. The transfer roller 14 is supported rotatably in a direction of an arrow in FIG. 1 in the casing 2. A transfer bias is applied to the roller shaft of the transfer roller 14 during transfer.

The fixing unit 17 is disposed at a side of the process unit 16 downstream with respect to the paper path, and has a heat roller 37, a pressure roller 38, and conveying rollers 39. The heat roller 37 has a halogen lamp in a metallic tube. The pressure roller 38 is disposed facing the heat roller 37 so as to press into contact with the heat roller 37 from below. The conveying rollers 39 are provided downstream from the heat roller 37 and the pressure roller 38 with respect to the paper path. Conveying rollers 40 are disposed downstream from the conveying rollers 39 with respect to the paper path. Ejecting rollers 41 are disposed further downstream and a discharged paper tray 42 is formed on the top surface of the casing 2.

The surface of the photosensitive drum 21 is first positively and uniformly charged by the scorotron charger 24, thereafter, irradiated with a laser beam emitted from the scanner unit 15, and an electrostatic latent image is formed based on predetermined image data. When the developing roller 28 is in contact with the photosensitive drum 21, toner carried on the surface of the developing roller 28 is supplied onto the latent image formed on the photosensitive drum 21, and the latent image is transformed into a visible image (toner image). By the rotation of the photosensitive drum 21, the toner image carried on the surface of the photosensitive drum 21 contacts a sheet 3 passing between the photosensitive drum 21 and the transfer roller 14 and is transferred onto the sheet 3 through the application of a transfer bias. The sheet 3 on which the toner image has been transferred is conveyed to the fixing unit 17.

While the sheet 3, conveyed to the fixing unit 17, passes between the heat roller 37 and the pressure roller 38, the toner transferred to the sheet 3 melts due to the applied heat and becomes fixed onto the sheet 3. The sheet 3 is conveyed by the conveying rollers 39 toward the conveying rollers 40 and the ejecting rollers 41. The sheet 3 is then conveyed to the ejecting rollers 41 by the conveying rollers 40 and ejected onto the discharged paper tray 42 by the ejecting rollers 41.

The laser printer 1 of the present embodiment is structured wherein the cleaning unit 47 cleans the wire 45 in synchronization with an action where the process unit 16 is attached to the casing 2 and another action where the process unit 16 is removed from the casing 2. The cleaning unit 47 cleans the wire 45 when the process unit 16 is attached to the casing 2 and when the process unit 16 is removed from the casing 2. The details will be described with reference to FIGS. 2 to 5.

Figure 2:
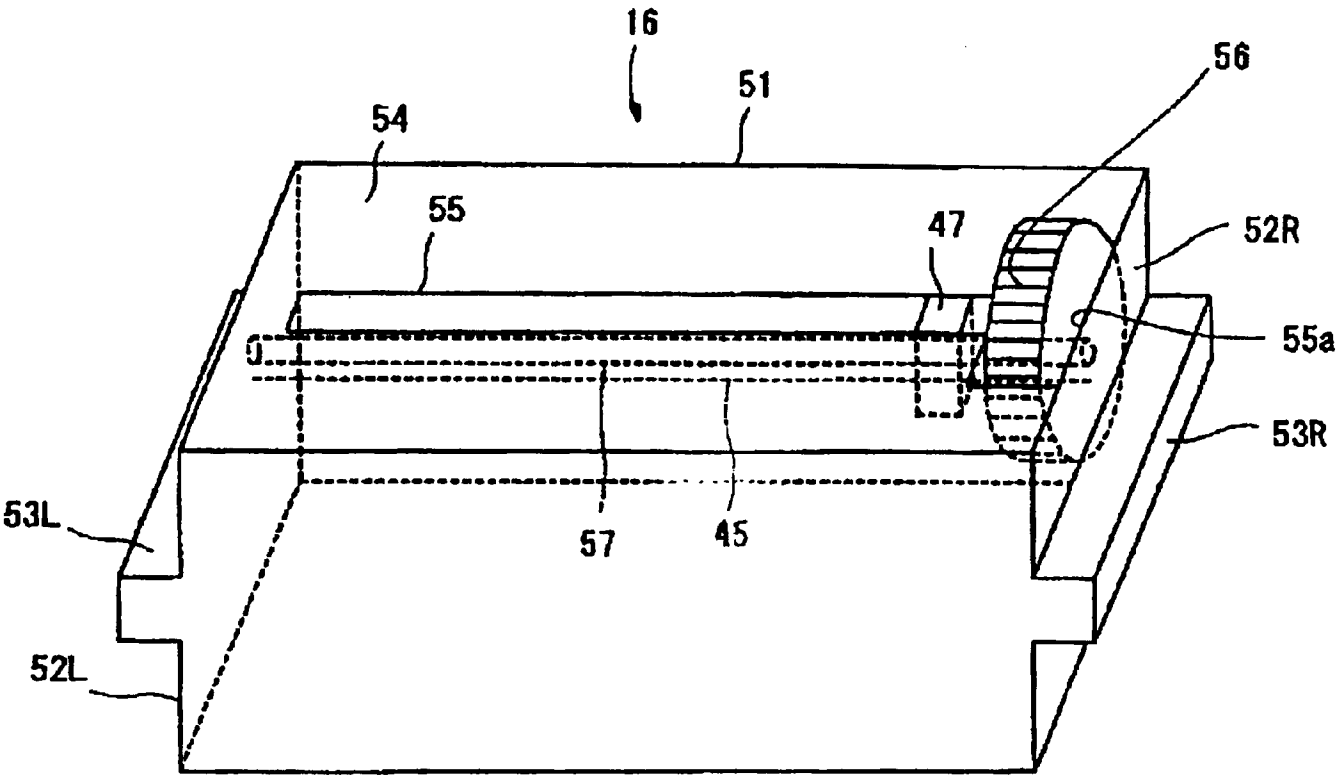
FIG. 2 is a perspective view of a process unit of the laser printer shown in FIG. 1.

The process unit 16 has the substantially rectangular box shaped housing 51 shown in FIG. 2. The housing 51 has sidewalls 52L and 52R facing each other. Protrusions 53L and 53R stick out externally from the sidewalls 52L and 52R. The protrusions 53L and 53R are designed to extend at the middle of the height of the housing 51 in a direction where the process unit 16 is attached or detached, in other words, along a front-to-rear direction of the laser printer 1.

A top wall 54 is provided on an upper surface defined between the sidewalls 52L and 52R of the housing 51. The top wall 54 has a substantially rectangular aperture 55 along the width direction of the housing 51. The aperture 55 is open along the longitudinal direction of the wire 45 such as to face the wire 45 of the scorotron charger 24. A gear receiving port 55*a* is in open communication with one end of the aperture 55 along the direction where the process unit 16 is attached or detached. A support shaft 57 is provided between the aperture 55 and the wire 45 in the housing 51. The support shaft 57 extends along the longitudinal direction of each of the aperture 55 and the wire 45 to face them, and is rotatably supported between the sidewalls 52L and 52R. The support shaft 57 is entirely threaded in its axial direction and has a gear 56 at one end such as to rotate integrally with the support shaft 57. The gear 56 is disposed such that it is partially exposed from the gear receiving port 55*a* of the housing 55.

Figure 3:
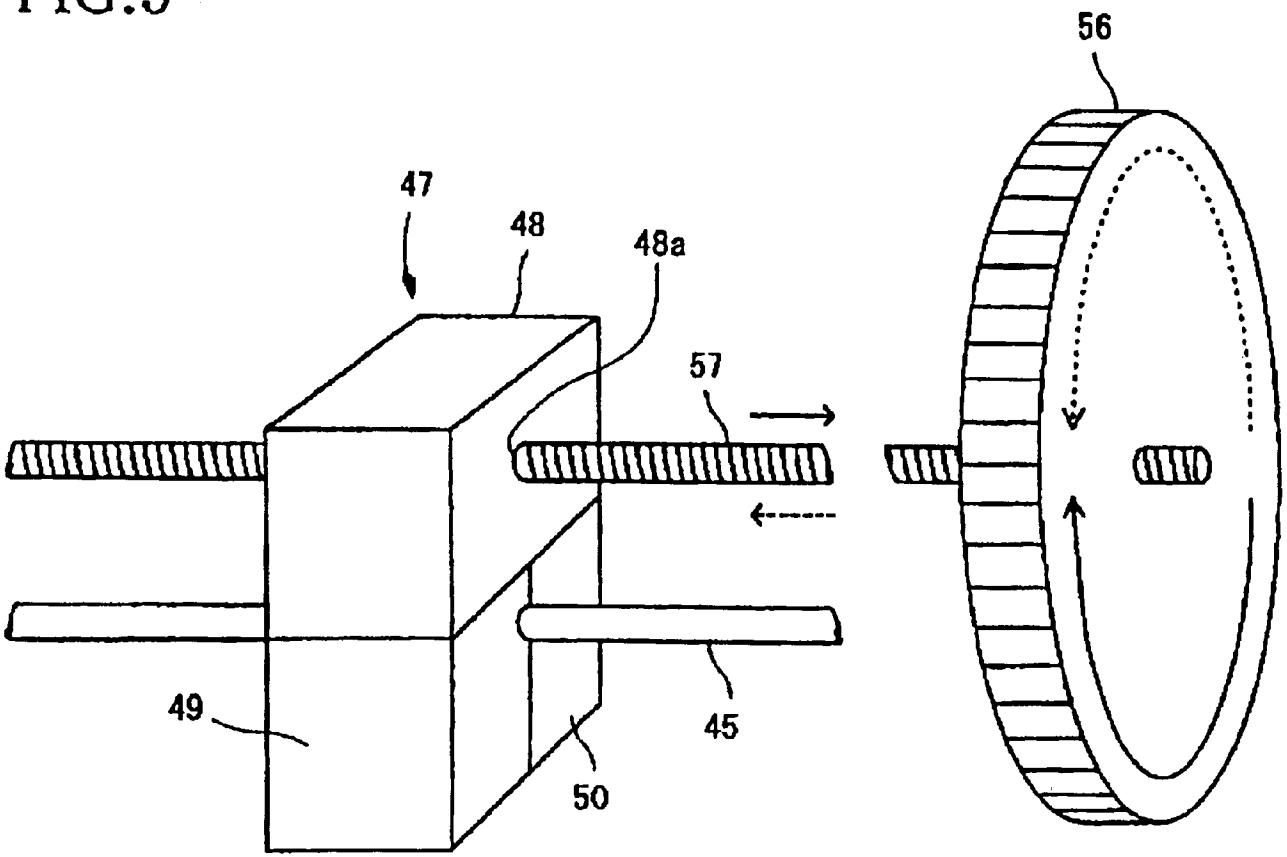
FIG. 3 shows a cleaning element included in the process unit.

As shown in FIG. 3, the cleaning unit 47 is attached to the support shaft 57 such that pinching members 49 and 50 hold the wire 45 slidably. The pinching members 49 and 50 are made of a felt-like fiber material, and fixed to the base 48. The base 48 includes a through hole 48*a* having threads on its inner surface to engage with the threads of the support shaft 57. Thus, when the support shaft 57 rotates, the base 48 is movable in the axial direction of the support shaft 57.

When the base 48 moves on the support shaft 57, friction is generated. Torque generated at a threaded portion between the base 48 and the support shaft 57 when the shaft 57 is rotated against the friction refers to a reference torque. When the base 48 reaches an end of the support shaft 57 and cannot move any further, the torque generated at the threaded portion between the base 48 and the support shaft 57 exceeds the reference torque. The base 48 is provided with an idling mechanism (not shown) for causing the base 48 to idle with respect to the support shaft 57 when the torque generated at a threaded portion between the base 48 and the support shaft 57 exceeds the reference torque. The idling mechanism is made up of a clutch mechanism that slides between the threaded portion of the base 48 and the threaded portion of the support shaft 57 when the torque generated during the normal rotation of the support shaft 57 exceeds the reference torque.

When the gear 56 rotates in the normal direction indicated by a solid line in FIG. 3, the support shaft 57 also rotates in the same direction as the normal direction of the gear 56. The base 48 of the cleaning unit 47 threaded onto the support shaft 57 moves on the support shaft 57 in the normal direction indicated by a solid line (rightward) in FIG. 3. The pinching members 49 and 50 move in the normal direction along the longitudinal direction of the wire 45 while holding the wire 45 therebetween, thereby the wire 45 is cleaned in the normal direction.

When the gear 56 rotates in the reverse direction indicated by a dot line in FIG. 3, the support shaft 57 also rotates in the same direction as the reverse direction of the gear 56. The base 48 of the cleaning unit 47 threaded onto the support shaft 57 moves on the support shaft 57 in the reverse direction indicated by a dot line (leftward) in FIG. 3. The pinching members 49 and 50 slide in the reverse direction along the longitudinal direction of the wire 45 while holding the wire 45 therebetween, thereby the wire 45 is cleaned in the reverse direction.

Figure 4:
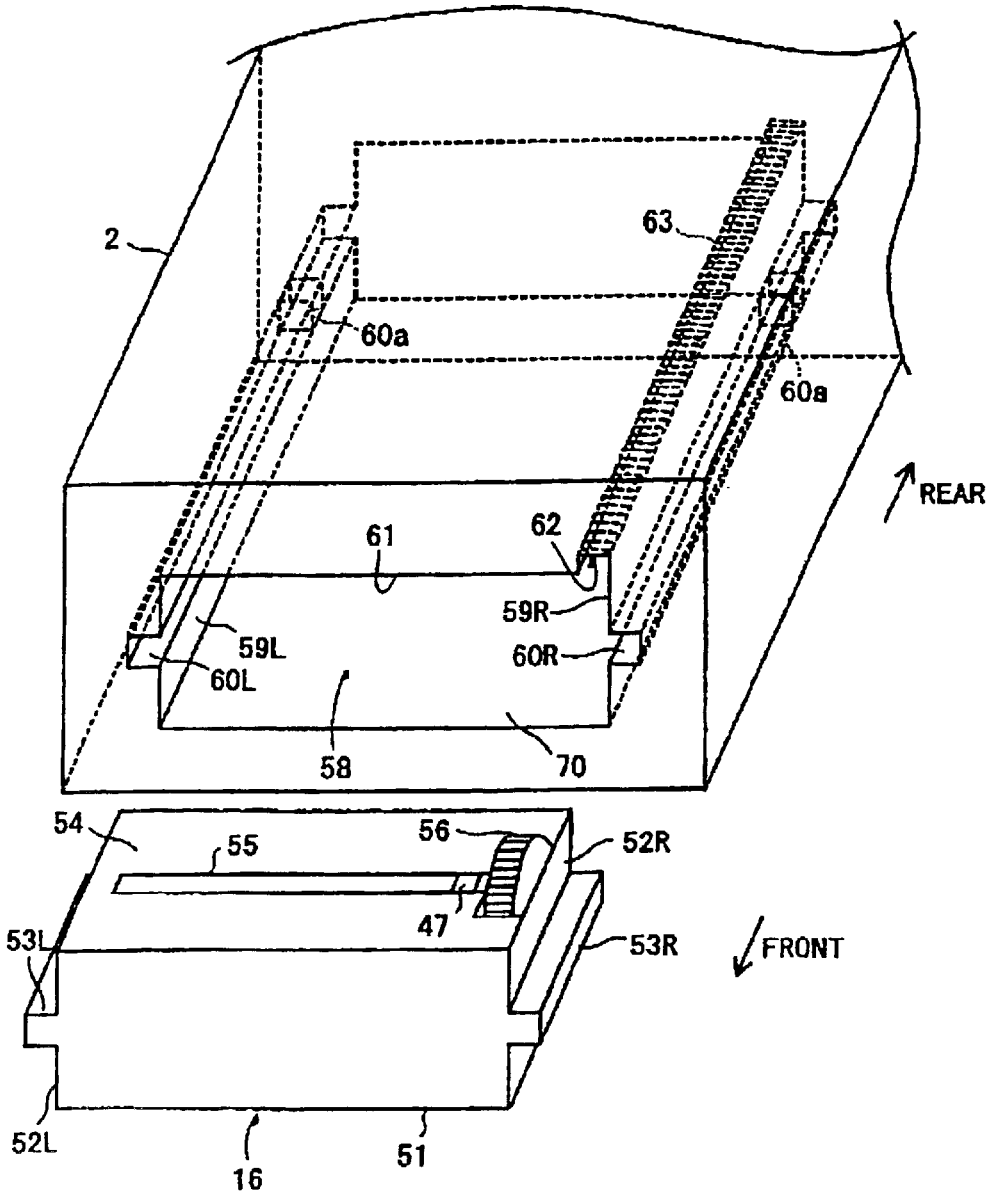
FIG. 4 shows that the process unit is not attached to a casing of the laser printer.

As shown in FIG. 4, the casing 2 is provided with a process unit mounting portion 58 where the process unit 16 passes through during mounting and demounting and is accommodated when mounted. The process unit mounting portion 58 is formed with a substantially rectangular box shaped opening 70 from the front surface of the casing 2 to the middle (to the front of the fixing unit 17 shown in FIG. 17). Sidewalls 59L and 59R are provided with guide portions 60L and 60R respectively, which are engageable with the protrusions 53L and 53R provided on the sidewalls 52L and 52R of the process unit 16.

Each of the guide portions 60L and 60R is formed in a substantially rectangular groove shape when viewed in a cross section, which is recessed outwardly from each of the sidewalls 59L and 59R and extends at the middle of the height of the process unit mounting portion 58 in a front-to-rear direction. The guide portions 60L and 60R are provided with positioning members 60*a* for determining the position of the process unit 16 within the casing 2.

The positioning members 60*a* are designed in the form of blocks to come in contact with rear ends of the protrusions 53L and 53R at the rear ends of the guide portions 60L and 60R and block the guide portions 60L and 60R. The positioning members 60*a* are positioned on a line extended from the contact between the photosensitive drum 21 and the transfer roller 14 when the process unit 16 is attached to the casing 2 and the protrusions 53L and 53R are in contact with the positioning members 60*a*.

A top wall 61 of the process unit mounting portion 58 has a rack portion 62 at one edge with respect to its width. The rack portion 62 is formed such as to match the gear pitch of the gear 56 of the process unit 16. The rack portion 62 is formed in a substantially rectangular shape, which is recessed upward from the top wall 61 and extends in the front-to-rear direction. The surface of the rack portion 62 is formed with rack teeth 63 along the direction where the rack portion 62 extends.

In the laser printer 1, the thread pitch of the support shaft 57 and the gear pitch of the gear 56 are set such as to enable the base 48 of the cleaning unit 47 to move on the support shaft 57 from one end to the other end by rotation of the gear 56 as it is engaged with the rack portion 62 from the front end to the rear end. Assuming that the gear 56 rotates 100 times while it moves from the front end of the rack portion 62 to the rear end, the support shaft 57 rotates 100 times and the base 48 moves from one end of the support shaft 57 to the other end. If the length of the wire 45 is substantially equal to the short side of an A4-sized sheet, the base 48 moves approximately 2.1 mm by one rotation of the gear 56.

Figures 5A, 5B, 5C:
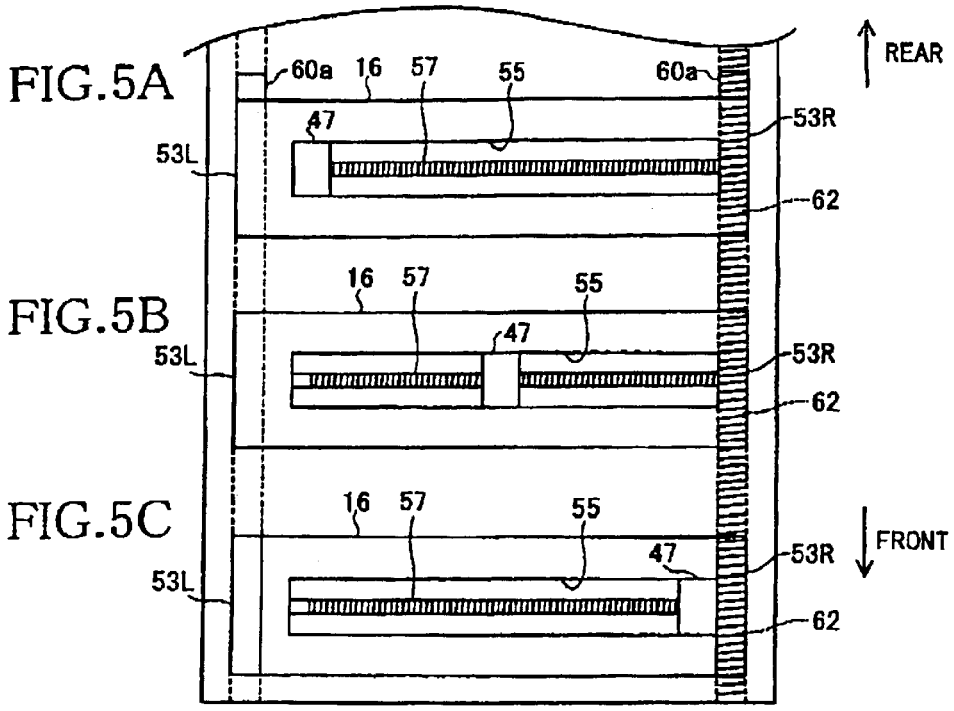
FIGS. 5A–5C show a movement of the cleaning element when the process unit is attached to or removed from the casing.

As shown in FIGS. 4 and 5C, when the process unit 16 is inserted into the opening 70 of the process unit mounting portion 58 with the cleaning unit 47 positioned at an end of the support shaft 57, the protrusions 53L and 53R of the process unit 16 are aligned with the guide portions 60L and 60R, the process unit 16 is moved rearward in the laser printer 1, and the gear 56 is engaged with the rack portion 62.

When the process unit 16 is moved further rearward in the laser printer 1 with the protrusions 53L and 53R guided by the guide portions 60L and 60R, the gear 56 rotates in the reverse direction by the engagement with the rack portion 62. Then, as shown in FIG. 5B, the cleaning unit 47 moves in the reverse direction on the support shaft 57, and the wire 45 is cleaned between the pinching members 49 and 50.

As shown in FIG. 5A, when the process unit 16 is moved until the protrusions 53L and 53R contact the positioning members 60*a*, the cleaning unit 47 is further moved on the support shaft 57, and reaches the other end of the support shaft 57. Thus, the cleaning unit 47 moves from one end of the wire 45 to the other end in synchronization with an operation where the process unit 16 is attached to the process unit mounting portion 58, thereby the pinching members 49 and 50 clean the wire 45*a* therebetween over its entire length.

When the process unit 16, in a state shown in FIG. 5A where the it is attached, is removed from the casing 2, it is moved toward the front of the printer 1 in the process unit mounting portion 58. The gear 56 is engaged with the rack portion 62 and rotates in the normal direction with the protrusions 53L and 53R guided by the guide portions 60L and 60R. The cleaning unit 47 moves in the normal direction on the support shaft 57 as shown in FIG. 5B, and the wire 45 is cleaned by the pinching members 49 and 50.

When the process unit 16 is moved further toward the front of the laser printer 1 in the process unit mounting portion 58, the cleaning unit 47 further moves in the normal direction on the support shaft 57 and reaches one end of the support shaft 57 as shown in FIG. 5C. As the cleaning unit 47 moves from one end to the other end of the wire 45 in synchronization with an operation where the process unit 16 is removed, the pinching members 49 and 50 clean the wire 45 therebetween over its entire length.

When the process unit 16 is further moved toward the front of the laser printer 1, the engagement between the protrusions 53L and 53R and the guide portions 60L and 60R is released, and the engagement between the gear 56 and the rack portion 62 is also released. As shown in FIG. 4, the process unit 16 is removed from the opening 70 of the process unit mounting portion 58 with the cleaning unit 47 positioned at one end of the support shaft 57.

As described above, the laser printer 1 is structured where the cleaning unit 47 moves along the longitudinal direction of the wire 45 in synchronization with the operations where the process unit 16 is attached to and removed from the casing 2 in the direction perpendicular to the longitudinal direction of the wire 45, and the wire 45 is cleaned. The process unit 16, attached to the casing 2, contacts the positioning members 60*a* thereby it is positioned at a specified place at all times, so that the wire 45 can be cleaned while the positioning accuracy of the photosensitive drum 21 can be kept.

The directions that the process unit 16 is attached to and removed from the casing 2 are the same as those that the sheet feed tray 6 is attached to and removed from the casing 2. Both the process unit 16 and the sheet feed tray 6 can be attached to and removed from the front surface of the casing 2, thereby improving the entire operation of the laser printer 1.

In the laser printer 1, when the developing cartridge 23 needs replacing, the cleaning unit 47 is moved from the other end of the wire 45, shown in FIG. 5A, to one end, shown in FIG. 5C, in synchronization with the operation where the process unit 16 is removed from the casing 2, and the wire 45 is entirely cleaned once. Thereafter, the spent developing cartridge 23 is removed from the process unit 16, and a new developing cartridge 23 is mounted in the process unit 16, and the process unit 16 is attached to the casing 2. As the cleaning unit 47 moves from one end of the wire 45, shown in FIG. 5C, to the other end, shown in FIG. 5A, in synchronization with the operation where the process unit 16 is attached to the casing 2, the wire 45 is entirely cleaned again. Thus, as the cleaning unit 47 reciprocates on the entire wire 45 while the process unit 16 is attached to and removed from the casing 2, cleaning of the wire 45 is performed twice, thereby the wire 45 is reliably cleaned.

The developing cartridge 23 cannot be attached to nor removed from the casing 2 directly. The developing cartridge 23 is designed to be attached to and removed from the casing 2 integrally with the housing 51 of the process unit 16, and the process unit 16 should be removed from the casing 2 when the developing cartridge 23 needs replacing. Thus, the frequency of cleaning of the wire 45 can be increased necessarily, thereby reliably keeping the charging performance of the scorotron charger 24.

In the laser printer 1, the cleaning unit 47 can be reliably moved by a simple mechanism with the engagement between the gear 56 and the rack portion 62, which contributes to a simplified structure of the laser printer 1. When the process unit 16 is attached to the casing 2, if the cleaning unit 47 is positioned in the middle of the support shaft 57 as shown in FIG. 5B, a force to move the cleaning unit 47 in the opposite direction is exerted while the process unit 16 is attached, although the cleaning unit 47 has already reached the other end of the support shaft 57. In this case, as torque, which exceeds a frictional resistance generated when the cleaning unit 47 is moved on the support shaft 57, generates the idling mechanism installed in the base 48 of the cleaning unit 47 operates to cause the base 48 to idle on the support shaft 57 and damage can be prevented. When the process unit 16 is attached to the casing 2, it can be set in place by the guide portions 60L and 60R and the positioning members 60*a* in the process unit mounting portion 58. In the above embodiment, the wire 45 is cleaned by engaging the gear 56 with the rack portion 62 in synchronization with the attachment and removal of the process unit 16, however, it may be cleaned in a different way.

Figure 6:
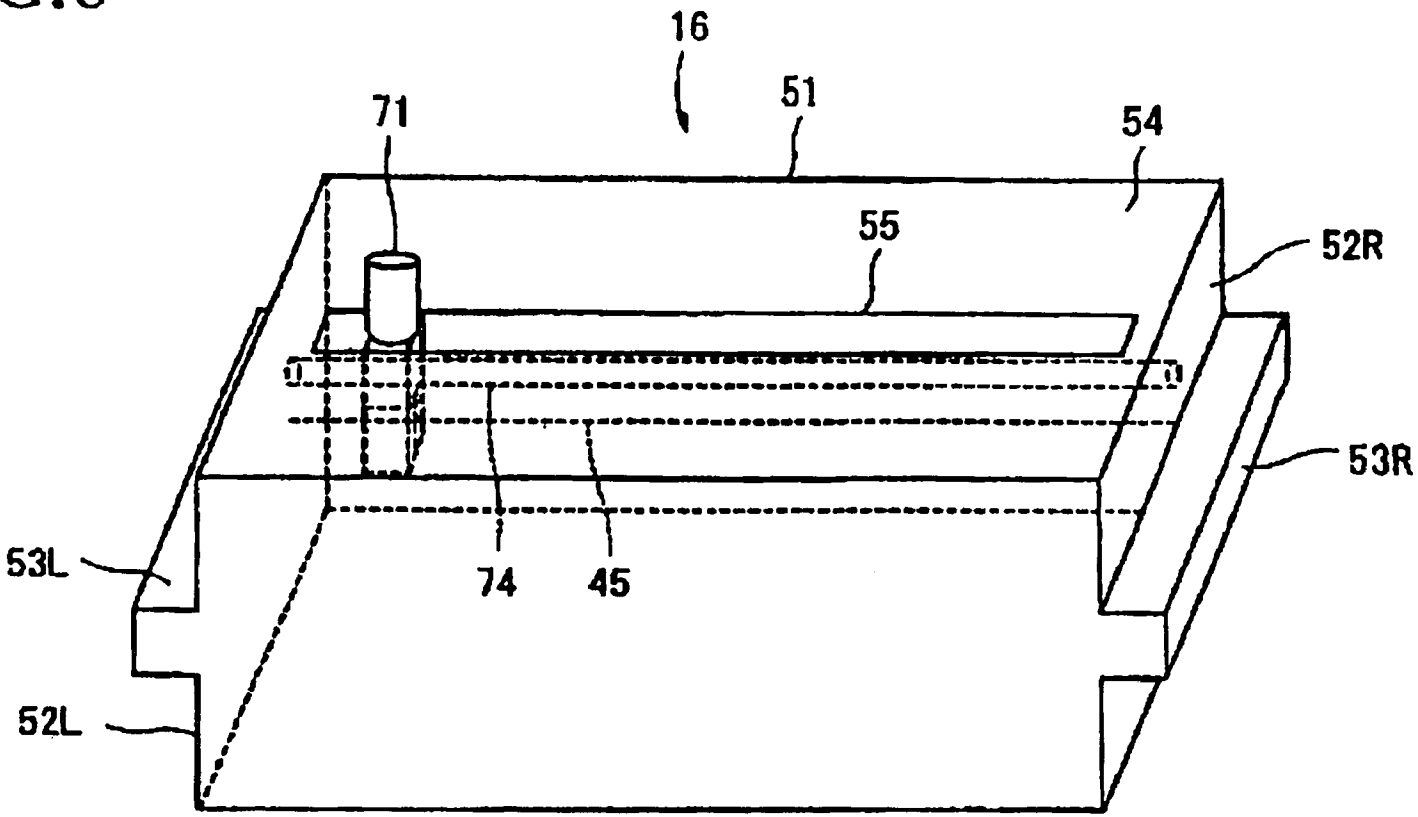
FIG. 6 is a perspective view of the process unit according to a second embodiment of the invention.

FIGS. 6 to 9 show a second embodiment. In the following description, elements already designated and described with reference to FIGS. 2 to 5 will not be redundantly described. In FIG. 6, the process unit 16 is formed with the aperture 55 and the protrusions 53L and 53R. In the process unit 16, a support shaft 74 is provided between the aperture 55 and the wire 45. The guide shaft 74 confronts with the aperture 55 and the wire 45, extends parallel to longitudinal directions of the aperture 55 and the wire 45 between the sidewalls 52L and 52R.

Figure 7:
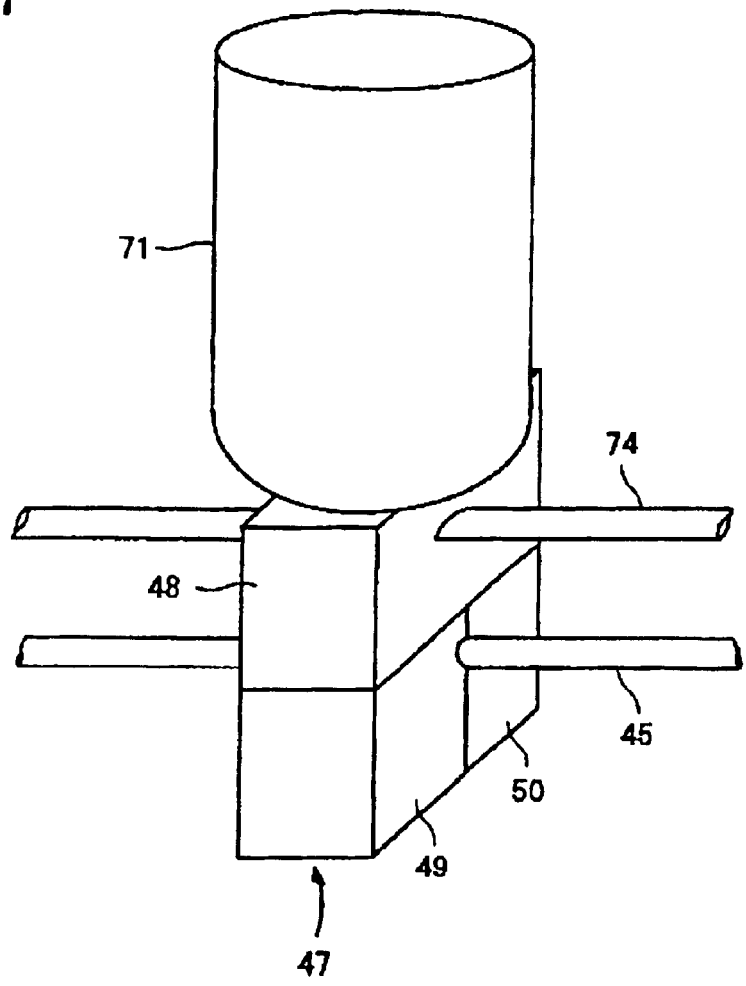
FIG. 7 shows a cleaning element included in the process unit according to the second embodiment.

As shown in FIG. 7, the base 48 of the cleaning unit 47 is slidably fitted around the guide shaft 74. The base 48 is fixed to the pinching member 49 and 50 that hold the wire 45 slidably. The cleaning unit 47 is formed integrally with a protrusion 71. As shown in FIGS. 6 and 7, the protrusion 71 has a cylindrical shape and is formed integrally with the base 48 thereon. The protrusion 71 is disposed such as to protrude upward from the top wall 54 of the process unit 16, and exposed from the aperture 55.

Figure 8:
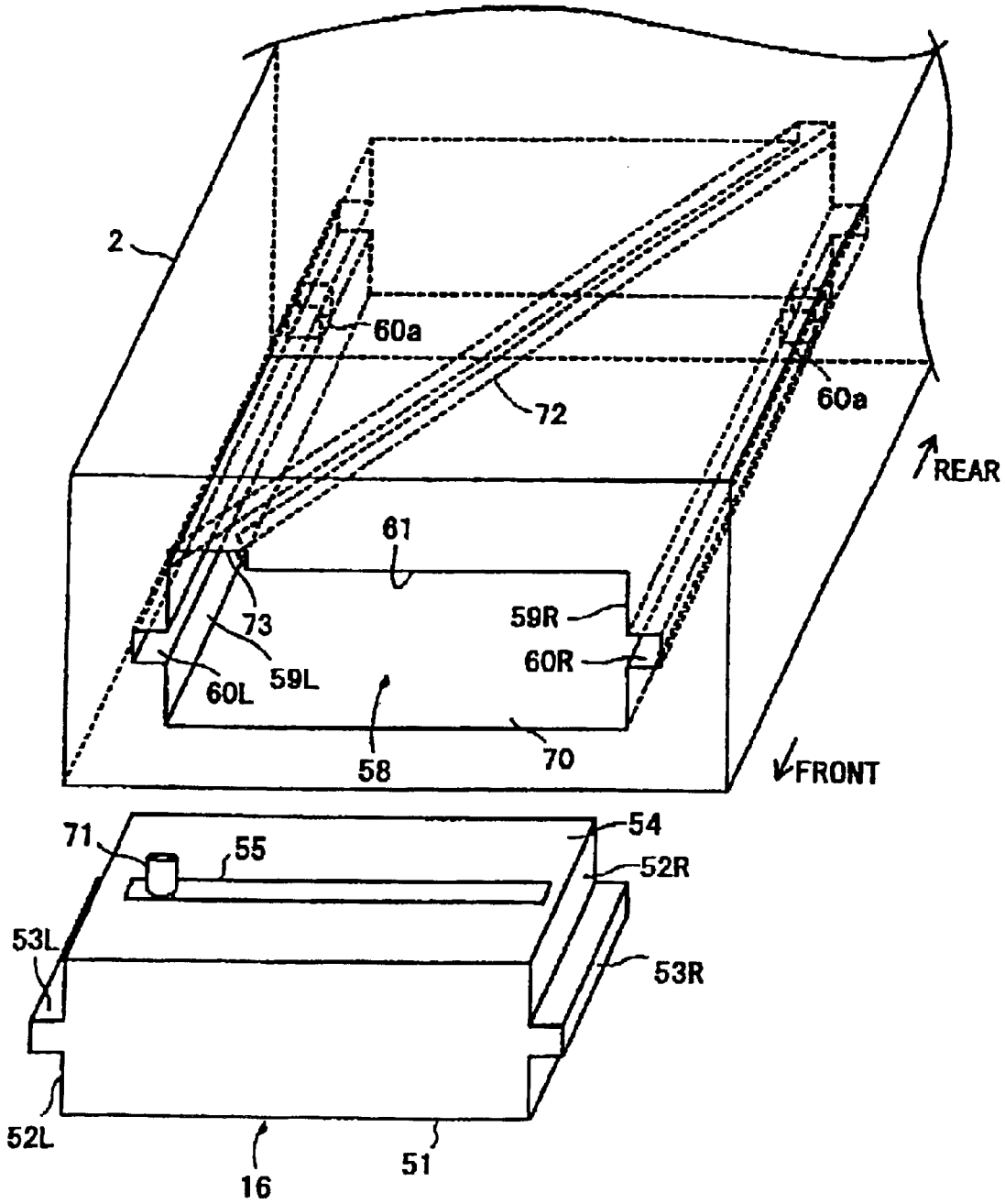
FIG. 8 shows that the process unit is not attached to a casing of the laser printer according to the second embodiment.

As shown in FIG. 8, the process unit mounting portion 58 of the casing 2 is formed with the guide portions 60L and 60R and the positioning members 60*a*. The process unit mounting portion 58 includes a guide groove 72 for receiving the protrusion 71.

The guide groove 72 is formed in a substantially rectangular shape when viewed in cross section and is recessed upward from the top wall 61. The guide groove 72 extends diagonally with respect to the front-to-rear direction of the top wall 61, such that the front end of the guide groove 72 is located on the sidewall 59L side, and the rear end is located on the sidewall 59R side. The guide groove 72 is set such that a length from one end of the guide groove 72 to the other end projected on the top wall 61 in the left to right direction (as shown in FIG. 8) is substantially equal to a length from one end of the wire 45 to the other end.

A receiving port 73 for receiving the protrusion 71 is provided at the front end of the guide groove 72. The receiving port 73 is created in a form of a substantially triangle spreading toward the front end of the guide groove 72 when viewed in a cross section, such that it is wider than any part of the guide groove 72, and the protrusion 71 can easily come in.

Figures 9A, 9B, 9C:
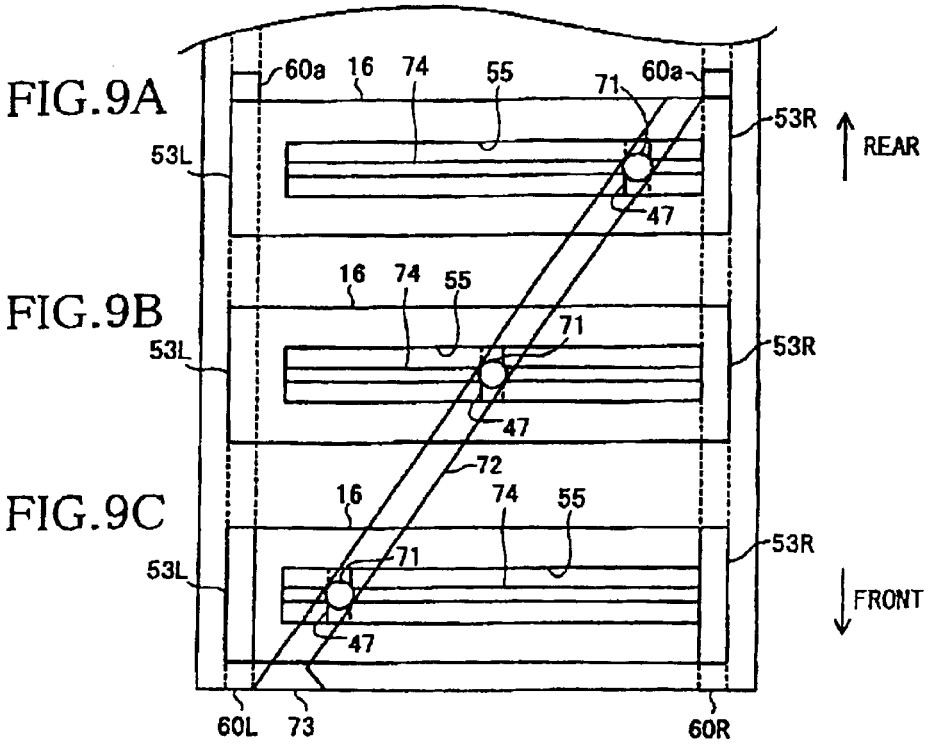
FIGS. 9A–9C show a movement of the cleaning element when the process unit is attached to or removed from the casing according to the second embodiment.

As shown in FIGS. 8 and 9C, when the process unit 16, where the protrusion 71 and the cleaning unit 47 are disposed at the other end of the guide shaft 74, is inserted into the opening 70 at the front end of the process unit mounting portion 58, the protrusions 53L and 53R are engaged with the guide portions 60L and 60R, the protrusion 71 is led in from the receiving port 73 and fitted in the guide groove 72 for engagement.

When the process unit 16 is moved toward the rear of the laser printer 1 within the process unit mounting portion 58 with the protrusions 53L and 53R guided by the guide portions 60L and 60R, the protrusion 71 is guided along the guide groove 72. As the protrusion 71 moves, the cleaning unit 47 moves on the guide shaft 74 from the state shown in FIG. 9C to the state shown in FIG. 9B. While the cleaning unit 47 moves in this way, the wire 45 is cleaned between the pinching members 49 and 50.

When the process unit 16 is further moved toward the rear of the laser printer 1 until the protrusions 53L and 53R contact the positioning members 60*a*, the cleaning unit 47 moves further toward the rear of the laser printer 1, the cleaning unit 47 moves on the guide shaft 74 and reaches one end of the guide shaft 74 as shown in FIG. 9A. Thus, as the cleaning unit 47 is moved from the other end of the guide shaft 74 to one end in synchronization with the operation where the process unit 16 is attached to the process unit mounting portion 58, the wire 45 is entirely cleaned between the pinching members 49 and 50.

When the process unit 16 is removed from the casing 2 from the state shown in FIG. 9A where the positioning members 60*a* are in contact with the protrusions 53L and 53R, the process unit 16 is moved toward the front of the laser printer 1 with a state where the protrusions 53L and 53R are guided by the guide portions 60L and 60R within the process unit mounting portion 58. As the protrusion 71 is guided along the guide groove 72 from the rear end to the front end, the cleaning unit 47 is moved on the guide shaft 74 from the state shown in FIG. 9A to the state shown in FIG. 9B, and the wire 45 is cleaned between the pinching members 49 and 50. When the process unit 16 is further moved toward the front within the process unit mounting portion 58, the cleaning unit 47 further moves on the guide shaft 74 and reaches the other end of the guide shaft 74 as shown in FIG. 9C. As the cleaning unit 47 moves from one end of the wire 45 to the other end in synchronization with the operation where the process unit 16 is removed, the wire 45 is cleaned over its entire length by the pinching members 49 and 50.

When the process unit 16 is further moved toward the front, the engagement between the protrusions 53L and 53R and the guide portions 60L and 60R is released, the protrusion 71 is separated from the receiving port 73, the cleaning unit 47 is located at the other end of the guide shaft 74, and the process unit 16 is removed from the opening 70 of the process unit mounting portion 58 as shown in FIG. 8.

As described above, during attachment and removal of the process unit 16, the protrusion 71, provided integrally with the cleaning unit 47, is engaged with and guided by the guide groove 72 formed in the process unit mounting portion 58, and the cleaning unit 47 is moved along the longitudinal direction of the wire 45. By a simple structure with the engagement between the protrusion 71 and the guide groove 72, the cleaning unit 47 is reliably moved and the wire 45 is excellently cleaned.

At the time of attachment of the process unit 16, the receiving port 73 of the guide groove 72 leads the protrusion 71 in, and the protrusion 71 smoothly slides in the guide groove 72. At the time of removal of the process unit 16, the protrusion 71 smoothly slides off the guide groove 72. Thus, the process unit 16 can be easily attached to and removed from the casing 2.

At the time of replacement of the developing cartridge 23, it is not necessary to completely remove the process unit 16 from the casing 2. The process unit 16 may be moved toward the front of the casing 2 such that it may not be completely removed from the casing 2, and the developing cartridge 23 may be removed from the process unit 16 and replaced with a new one. Even in this case, the cleaning unit 47 can move in synchronization with the movement of the process unit 16, thereby the wire 45 can be reliably cleaned.

The above descriptions are made based on the laser printer 1 of monochrome type, however, the invention may be applied to multi-color laser printers. The cleaning unit 47 is made up of the base 48 and the pinching members 49 and 50, however, the base 48 may be formed integrally with the pinching members 49 and 50.

While the invention has been described in detail and with reference to the specific embodiments thereof, it should be apparent to those skilled in the art that various changes, arrangements and modifications may be applied therein without departing from the spirit and scope of the invention.

What is claimed is:

1. An image forming apparatus, comprising:

a photosensitive device;

a wire disposed along an axial direction of the photosensitive device;

a cleaning unit slidably contacting the wire along a longitudinal direction of the wire;

a process unit supporting the photosensitive device, the wire and the cleaning unit;

a guide portion that accommodates the process unit, is perpendicular to the longitudinal direction of the wire, and guides the process unit upon movement of the process unit; and a moving device that moves the cleaning unit in the longitudinal direction of the wire in synchronization with the movement of the process unit.

2. The image forming apparatus according to claim 1, further comprising:

an accommodating portion that accommodates the process unit therein, wherein the process unit is guided by the guide portion while the process unit is attached to or removed from the accommodating portion.

3. The image forming apparatus according to claim 1, the moving device comprising:

a driving member that is provided with the process unit and moves the cleaning unit; and a contacting member that is provided with a casing of the image forming apparatus and contacts the driving member.

4. The image forming apparatus according to claim 3, wherein the driving member and the contacting member move the cleaning unit from a first end to a second end in the longitudinal direction of the wire in synchronization with an operation where the process unit is attached to an accommodating portion, and the driving member and the contacting member move the cleaning unit from the second end to the first end in the longitudinal direction of the wire in synchronization with an operation where the process unit is removed from the accommodating portion.

5. The image forming apparatus according to claim 4, wherein the driving member has a support shaft extending parallel to the longitudinal direction of the wire and rotatably supported and a gear rotatable integrally with the support shaft, the contacting member is provided parallel to an attachment direction of the process unit and includes a rack engaged with the gear, the support shaft has a plurality of threads on a surface of the support shaft with specified pitches, and the cleaning unit has a through hole defined by a surrounding surface formed with a plurality of threads having pitches identical to the pitches of the support shaft, and the cleaning unit reciprocates on the support shaft by rotation of the support shaft.

6. The image forming apparatus according to claim 4, wherein the driving member is a protrusion provided integrally with the cleaning unit, the contacting member is provided between the first end and the second end of the wire and has a groove to be engaged with the protrusion, and the protrusion moves from the first end of the wire to the second end when in a state of engagement with the groove upon the movement of the process unit.

7. The image forming apparatus according to claim 6, wherein the groove has a substantially constant width and includes one end with a wider width.

8. The image forming apparatus according to claim 2, wherein the accommodating portion includes a positioning portion contacting the process unit.

9. The image forming apparatus according to claim 8, wherein the positioning portion is provided in the guide portion and contacts both ends of the process unit with respect to the longitudinal direction of the wire.

10. The image forming apparatus according to claim 1, further comprising:

a casing having an openable cover and an opening, wherein the cover opens in a direction perpendicular to the longitudinal direction of the wire.

11. The image forming apparatus according to claim 10, wherein the process unit has a housing supporting the photosensitive device and a developing cartridge supporting a developing agent carrier, and the developing cartridge is detachable from the housing.

12. The image forming apparatus according to claim 11, wherein the process unit is detachable through the opening with the developing cartridge attached to the housing.

13. The image forming apparatus according to claim 12, further comprising:

a cassette disposed detachably from the casing and accommodating a sheet therein, wherein a direction where the cassette is placed in the casing is identical to a direction where the process unit is attached to the casing.

14. A method of cleaning a wire disposed along an axial direction of a photosensitive device, comprising:

moving a cleaning unit in a longitudinal direction of the wire in synchronization with a movement of a process unit, wherein the cleaning unit is in slidable contact with the wire along the longitudinal direction of the wire, the process unit supports the photosensitive device, the wire and the cleaning unit and a guide portion accommodates the process unit, is perpendicular to the longitudinal direction of the wire, and guides the process unit upon movement of the process unit.

15. The method of claim 14, further comprising:

moving the cleaning unit from a first end to a second end in the longitudinal direction of the wire in synchronization with an operation where the process unit is moved relative to the guide portion in a first direction; and moving the cleaning unit from the second end to the first end in the longitudinal direction of the wire in synchronization with an operation where the process unit is moved relative to the guide portion in a second direction.

16. The method of claim 15, wherein the process unit is moved relative to the guide portion in the first direction and the second direction by moving a driving member that is provided with the process unit relative to a contacting member that is provided with a casing of the image forming apparatus and contacts the driving member.

* * * * *